US008689781B1

(12) United States Patent
Chilton et al.

(10) Patent No.: US 8,689,781 B1
(45) Date of Patent: Apr. 8, 2014

(54) OVEN APPLIANCE

(71) Applicant: General Electric Company, Schenectady, NY (US)

(72) Inventors: John Mark Chilton, Campbellsburg, KY (US); John Adam Yantis, Prospect, KY (US); Scott Thomas Kershner, LaGrange, KY (US); Joshua Stephen Wiseman, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/738,216

(22) Filed: Jan. 10, 2013

(51) Int. Cl.
*F24C 15/04* (2006.01)

(52) U.S. Cl.
USPC ..... 126/192; 126/197; 126/191

(58) Field of Classification Search
USPC ..... 126/192, 197, 191, 190; 49/366, 367, 49/368; 110/173 R, 176
See application file for complete search history.

(56) References Cited

U.S. PATENT DOCUMENTS

| | | | | |
|---|---|---|---|---|
| 3,091,232 | A | 5/1963 | Allen, Jr. et al. | |
| 7,735,480 | B2 | 6/2010 | Larsen et al. | |
| 7,814,897 | B2 | 10/2010 | Larsen | |
| 2007/0246036 | A1 | 10/2007 | Larsen et al. | |
| 2010/0206289 | A1 | 8/2010 | Larsen et al. | |
| 2013/0233294 | A1 * | 9/2013 | Yantis et al. | 126/197 |

* cited by examiner

*Primary Examiner* — Alfred Basichas
(74) *Attorney, Agent, or Firm* — Dority & Manning, P.A.

(57) ABSTRACT

An oven appliance is provided. The oven appliance includes a cabinet and a pair of doors mounted to the cabinet. A latch selectively secures one of the pair of doors in a closed position. A pair of seals assists with sealing the chamber of the cabinet when the pair of doors is in the closed position. The seals of the pair of seals overlap and engage each other when the pair of doors is in the closed position such that both doors of the pair of doors are secured in the closed position when the latch secures the one of the pair of doors in the closed position.

18 Claims, 5 Drawing Sheets

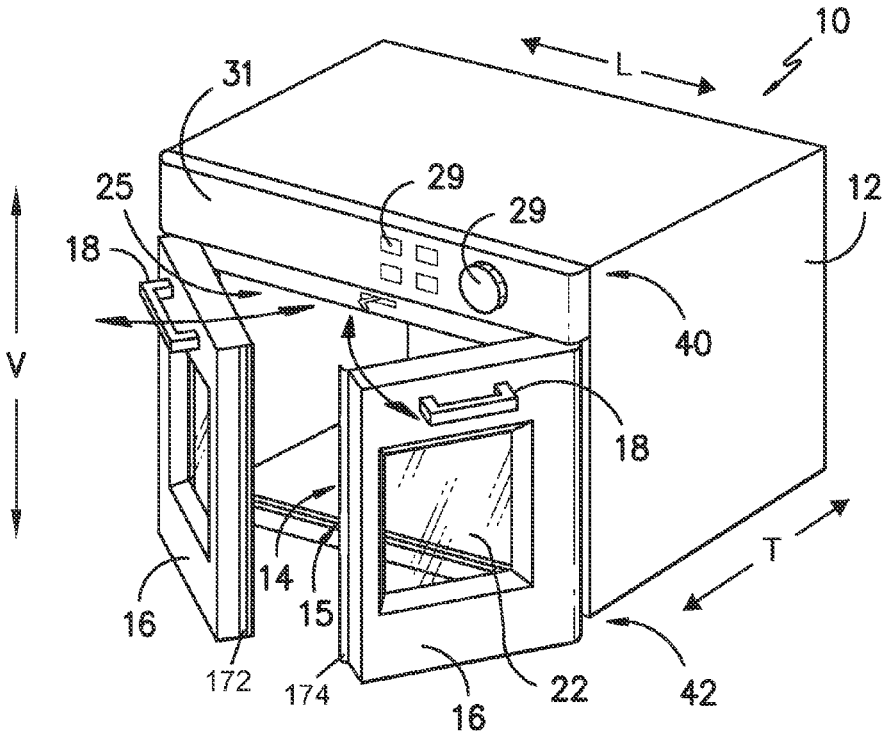
FIG. —1—
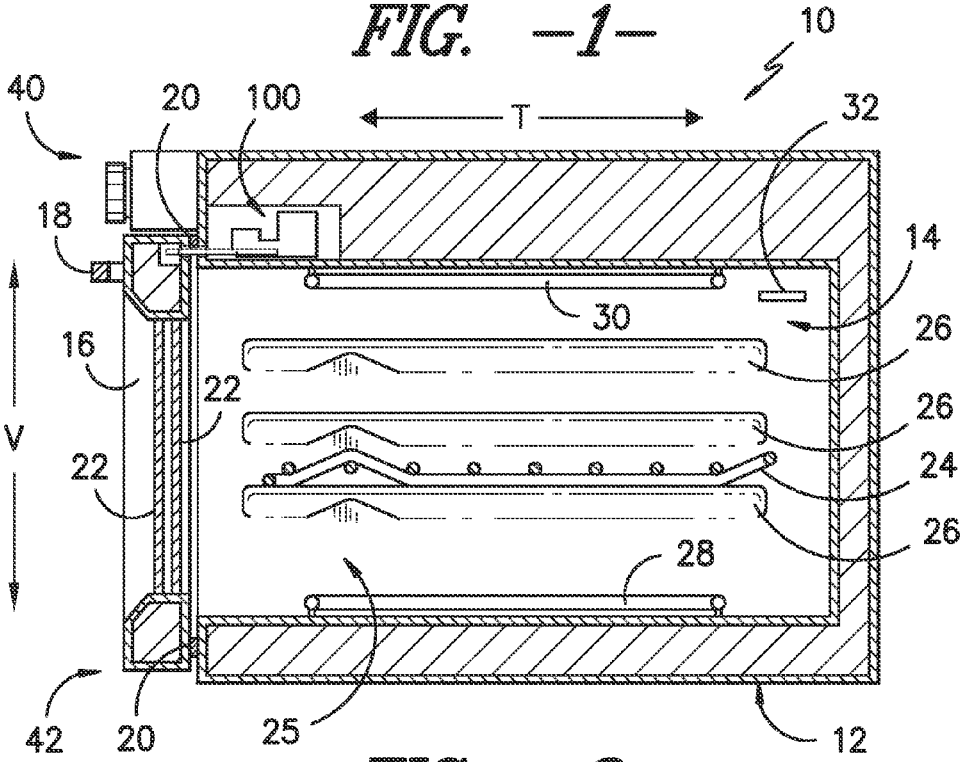
FIG. —2—

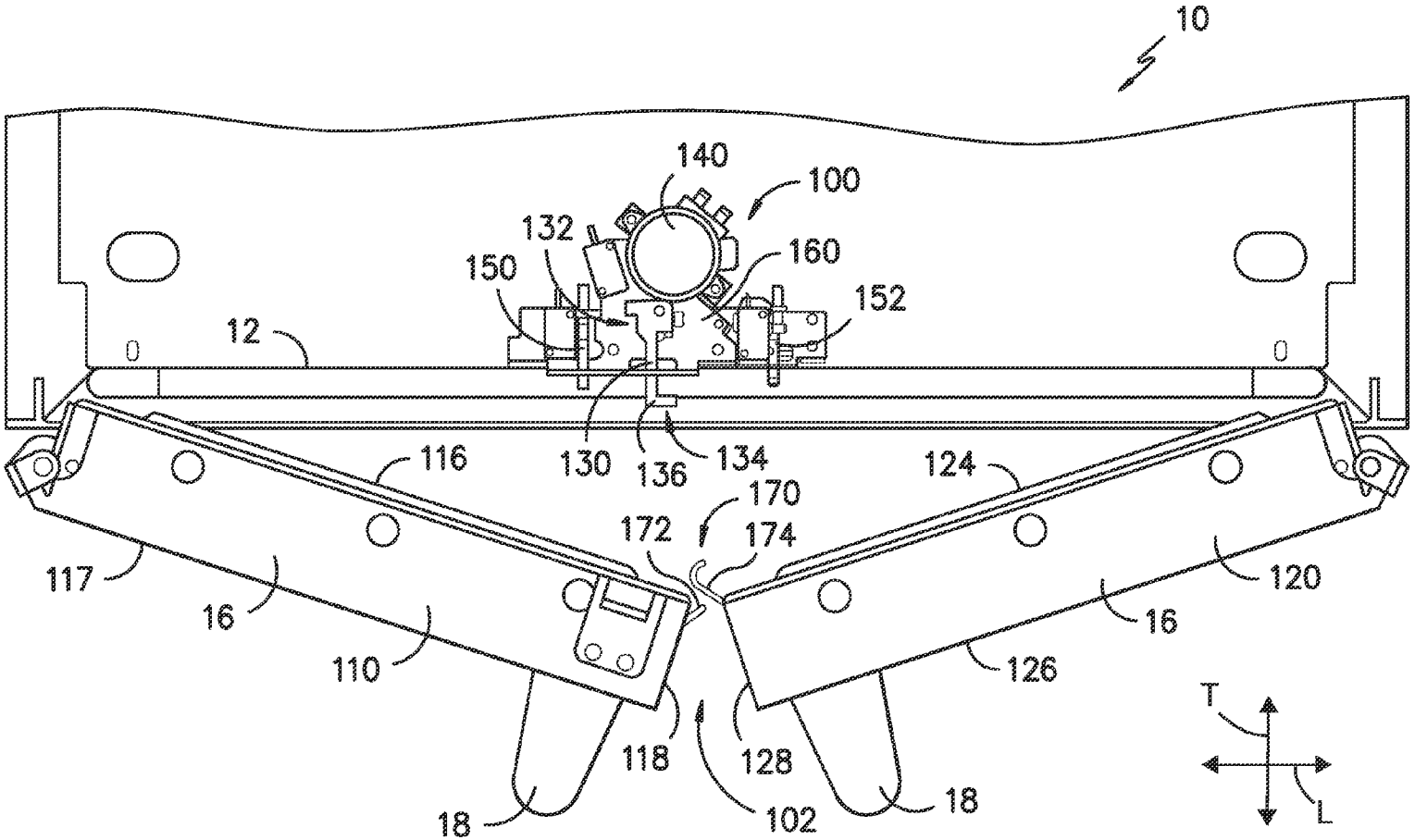
FIG. —3—

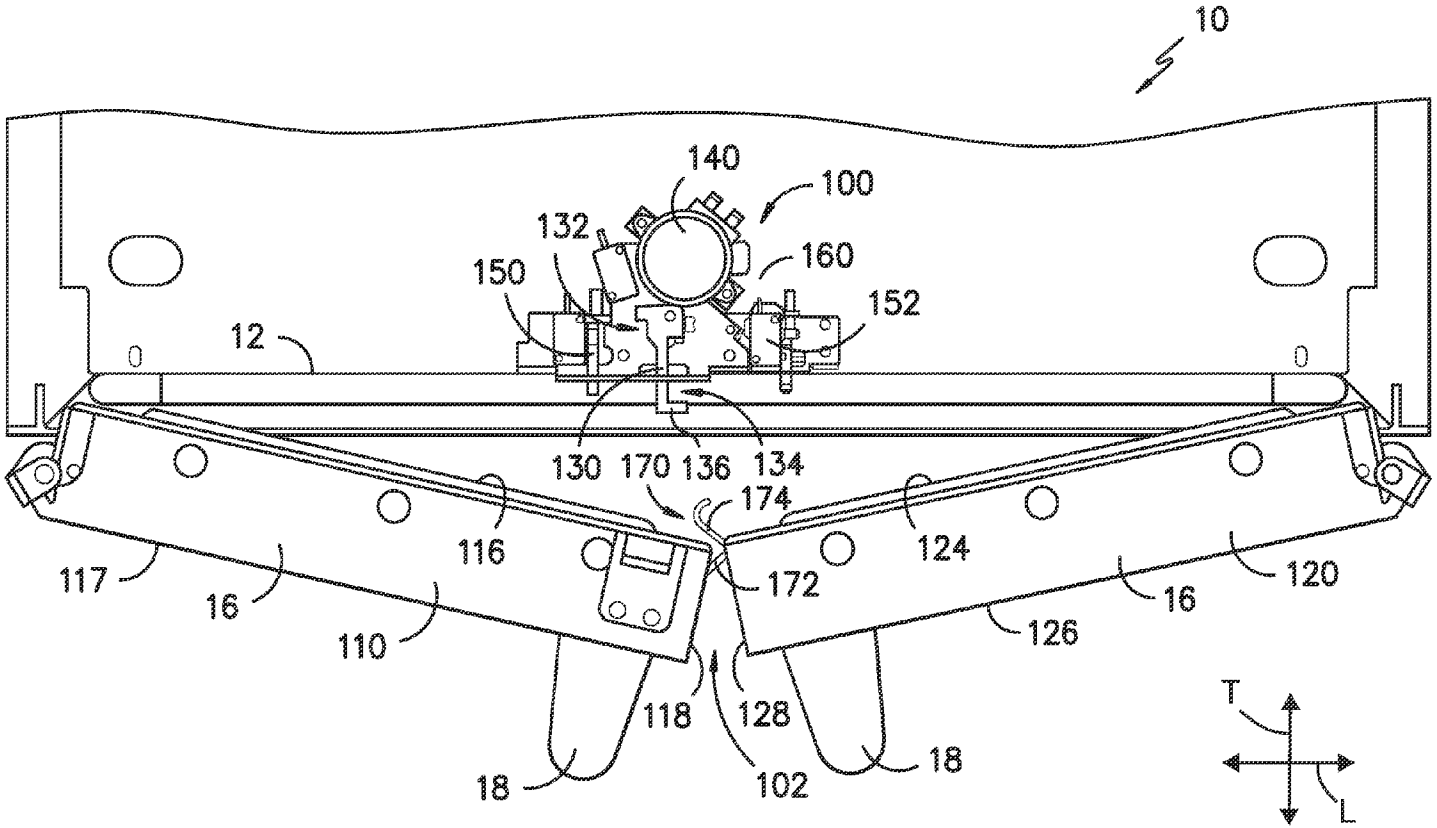
FIG. —4—

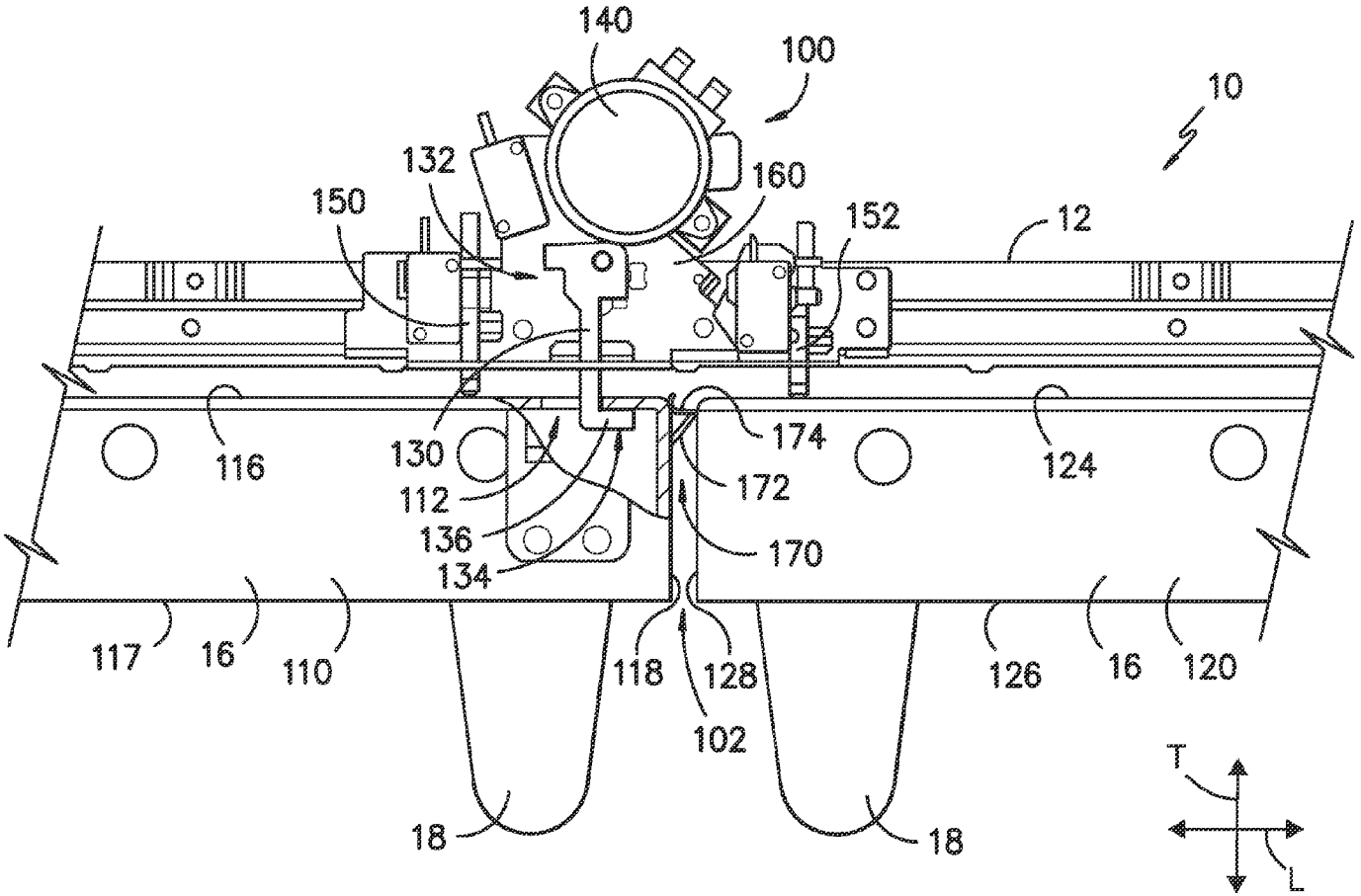
FIG. —6—

OVEN APPLIANCE

FIELD OF THE INVENTION

The present subject matter relates generally to oven appliances e.g., French door oven appliances.

BACKGROUND OF THE INVENTION

Oven appliances generally include a cabinet that defines a cooking chamber for receipt of food articles for cooking. The cabinet can also define an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

During certain oven operations or cycles, e.g., a cleaning cycle, access to an oven's cooking chamber is preferably restricted. During such oven cycles, the cooking chamber can reach high temperatures. In order to reduce the risk of potential injury, the oven's door(s) are locked in a closed position such that a user cannot access the cooking chamber.

Certain French door style oven appliances have a linkage assembly for transferring the motion of one oven door to the other oven door. Thus, a user can open and/or close both of the doors by urging one of the doors open and/or closed. To secure both doors in a closed position, certain French door oven appliances secure one of the doors in a closed position, e.g., using a latch. With one of the doors secured, the linkage assembly prevents the other door from opening. However, relying upon the linkage assembly to secure both of the doors in the closed position can be problematic. For example, a user attempting to open a locked door can place a great amount of stress upon the linkage assembly. Also, the linkage assembly can have an amount of slack that permits the doors to open at least partially and/or slightly in the closed position. Accordingly, an oven appliance with features for securing the oven appliance's doors in a closed position without relying upon the appliance's linkage assembly would be useful.

In addition, certain French door style oven appliances have a pair of latches. Each of latches is configured for securing a particular one of the pair of doors. However, using a pair of latches to secure an oven's doors in a closed position can also be problematic. For example, using a pair of latches can add to the cost and/or complexity of the oven appliance. Additionally, both of the latches must be activated in order to secure both of the oven's doors in the closed position. Accordingly, an oven appliance with features for securing the oven appliance's doors in a closed position without using a pair of latches would be useful.

BRIEF DESCRIPTION OF THE INVENTION

The present subject matter provides an oven appliance. The oven appliance includes a cabinet and a pair of doors mounted to the cabinet. A latch selectively secures one of the pair of doors in a closed position. A pair of seals assists with sealing the chamber of the cabinet when the pair of doors is in a closed position. The seals of the pair of seals overlap and engage each other when the pair of doors is in the closed position, and both doors of the pair of doors are secured in the closed position when the latch secures the one of the pair of doors in the closed position. Additional aspects and advantages of the invention will be set forth in part in the following description, or may be apparent from the description, or may be learned through practice of the invention.

In a first exemplary embodiment, an oven appliance is provided. The oven appliance includes a cabinet that defines a chamber for the receipt of food items for cooking and a heating element for heating the chamber of the cabinet. A first door and a second door are rotatably mounted to the cabinet. The first and second doors each have an exterior wall spaced apart from an interior wall with a sidewall extending between the exterior and interior walls. The sidewalls of the first and second doors define a gap therebetween when the first and second doors are in a closed position. A latch is mounted to the cabinet and is configured for selectively securing the first door in the closed position. A first seal is mounted to the first door at the gap between the first and second doors. A second seal is mounted to the second door at the gap between the first and second doors. The first and second seals are in overlapping contact with each other when the first and second doors are in the closed position such that the second door is secured in the closed position when the latch secures the first door in the closed position.

In a second exemplary embodiment, an oven appliance is provided. The oven appliance includes a cabinet that defines a chamber for the receipt of food items for cooking and a heating element for heating the chamber of the cabinet. The cabinet defines a lateral direction and a vertical direction. A pair of doors is rotatably mounted to the cabinet. The pair of doors defines a gap therebetween when the pair of doors is in a closed position. A latch is mounted to the cabinet and is configured for selectively securing one of the pair of doors in the closed position. A pair of seals is positioned at the gap between the pair of doors for assisting with sealing the chamber of the cabinet when the pair of doors is in the closed position. Each seal of the pair of seals extends longitudinally along the vertical direction. Each seal of the pair of seals is mounted to a respective door of the pair of doors and extends into the gap along the lateral direction. The seals of the pair of seals engage and overlap each other when the pair of doors is in the closed position such that both doors of the pair of doors are secured in the closed position when the latch secures the one of the pair of doors in the closed position.

In a third exemplary embodiment, an oven appliance is provided. The oven appliance includes a cabinet defining a chamber for the receipt of food for cooking. The chamber is accessible through an opening defined by the cabinet. The oven appliance also includes a heating element for providing heat to the food for cooking in the chamber. A first door and a second door are mounted proximate to the opening. The first and second doors are configured for permitting selective access to the chamber of the cabinet. The oven appliance further includes means for selectively securing the first door in a closed position and means for securing the second door in the closed position when the first door is secured in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 provides a front, perspective view of an oven appliance according to an exemplary embodiment of the present subject matter and, in particular, illustrates a pair of doors of the oven appliance in an open position.

FIG. 2 provides a side, section view of the oven appliance of FIG. 1 and, in particular, illustrates an exemplary lock assembly securing the doors of the oven appliance in a closed position.

FIGS. 3-4 provide partial, section views of the oven appliance of FIG. 1 and, in particular, illustrate a pair of seals mounted to the pair of doors.

FIGS. 5-6 provide partial, section views of the oven appliance of FIG. 1 and, in particular, illustrate the lock assembly selectively securing one of the pair of doors in the closed position.

DETAILED DESCRIPTION

Figure 5:
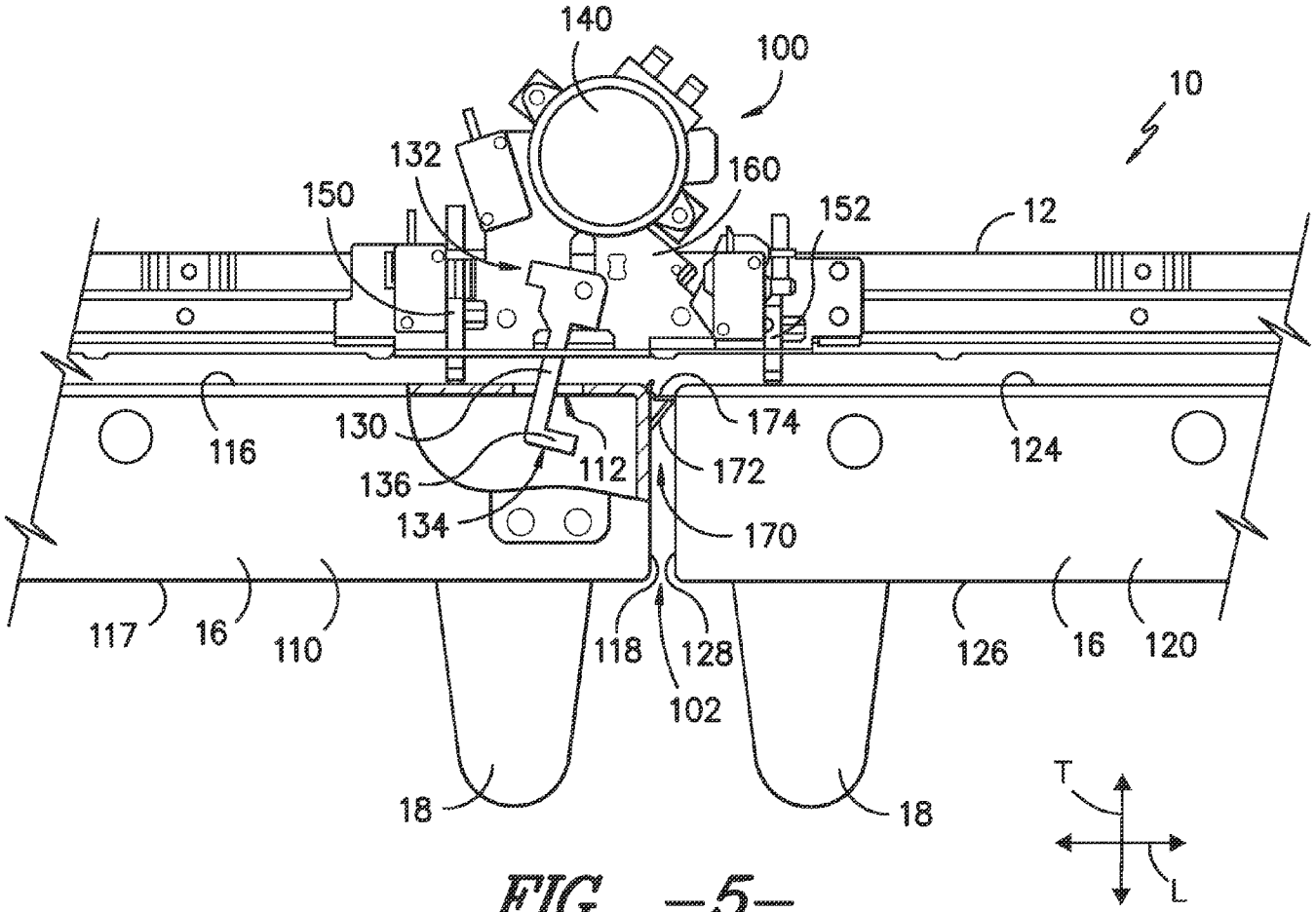

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an oven appliance 10 according to an exemplary embodiment of the present subject matter. Oven appliance 10 includes an insulated cabinet 12 with an interior surface 25 that defines a cooking chamber 14. Cooking chamber 14 is configured for the receipt of one or more food items to be cooked.

Cabinet 12 extends between a top 40 and a bottom 42 along a vertical direction V. Cabinet 12 also defines a lateral direction L and a transverse direction T. The vertical, lateral, and transverse directions V, L, and T are mutually perpendicular and form an orthogonal direction system.

Oven appliance 10 also includes a pair of doors 16 rotatably mounted on cabinet 12 proximate to an opening 15 to chamber 14 defined by cabinet 12. Thus, oven appliance 10 is sometimes referred to as a French door style oven appliance. Doors 16 are configured for selectively shifting between an open position or configuration shown in FIG. 1 in which a user can access cooking chamber 14 and a closed position or configuration shown in FIG. 2 in which the user is impeded from accessing cooking chamber 14 by doors 16. Handles 18 are attached to doors 16 and allow for shifting doors 16 between the open and closed positions.

One or more gaskets 20 between doors 16 and cabinet 12 provide for maintaining heat and cooking fumes within chamber 14 when doors 16 are in the closed position as shown in FIG. 2. Glass panes 22 provide for viewing the contents of chamber 14 when doors 16 are in the closed position as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16 are open. Multiple rails 26 are provided so that the height of rack 24 may be adjusted.

Heating elements 28 and 30 are positioned within chamber 14 of cabinet 12. Heating elements 28 and 30 are used to heat chamber 14 for both cooking and cleaning of oven appliance 10. While electrically-resistive heating elements 28 and 30 are shown, the present invention may be used with other heating elements as well such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors can be placed within oven appliance 10 for determining the oven temperature.

Oven appliance 10 is provided by way of example only. Thus, the present subject matter may be used in any other suitable oven appliance configuration. For example, the present subject matter may be used in oven range appliances or in oven appliances that define multiple interior cavities for the receipt of food and/or have different pan or rack arrangements than the exemplary embodiment shown in FIG. 2. Heating elements at the top, back, or sides of chamber 14 may also be provided, and a variety of different types of heating elements such as microwave, halogen, gas fuel, electrical resistance, and combinations thereof may be used. Other configurations may also be used as will be understood by one of skill in the art using the teachings disclosed herein.

As may be seen in FIG. 2, oven appliance 10 includes a lock assembly 100. Lock assembly 100 is configured for selectively securing one of doors 16 in the closed position. For example, during a cleaning cycle of oven appliance 10, cooking chamber 14 and heating elements 28, 30 can reach high temperatures. Lock assembly 100 may secure one of doors 16 in the closed position during the cleaning cycle, e.g., in order to prevent the user from opening doors 16 and accessing cooking chamber 14 as discussed in greater detail below.

FIGS. 3 and 4 provide partial, section views of oven appliance 10, lock assembly 100 for securing one of doors 16 in the closed position, and a pair of seals 170 mounted to doors 16. In FIG. 3, doors 16 are in the open position such that the pair of seals 170 is disengaged. In FIG. 4, doors 16 are rotated towards the closed position from the open position shown in FIG. 3 such that the pair of seals 170 is beginning to engage as discussed in greater detail below.

Doors 16 include a first door 110 and a second door 120. First door 110 has an interior wall 116 and an exterior wall 117. Interior wall 116 is spaced apart from exterior wall 117, e.g., along the transverse direction T. A sidewall 118 extends between interior wall 116 and exterior wall 117, e.g., along the transverse direction T. When first door 110 is in the closed position interior wall 116 of first door 110 cooperates with interior surface 25 (FIG. 1) of cabinet 12 to form cooking chamber 14 (FIG. 1). As discussed below, lock assembly 100 is configured for selectively engaging first door 110 and securing first door 110 in the closed position.

Second door 120 also has an interior wall 124 and an exterior wall 126. Interior wall 124 of second door 120 is spaced apart from exterior wall 126 of exterior door 120, e.g., along the transverse direction T. A sidewall 128 extends between interior wall 124 and exterior wall 126 of exterior door 120, e.g., along the transverse direction T. When second door 120 is in the closed position, interior wall 124 of second door 120 cooperates with interior surface 25 (FIG. 1) of cabinet 12 to form cooking chamber 14 (FIG. 1).

Lock assembly 100 includes a latch 130 that is rotatably mounted to a support plate 160 and selectively engages first door 110 in order to secure first and second doors 110, 120 in the closed position as described in greater detail below. Support plate 160 is mounted to cabinet 12 and positioned above chamber 14 within cabinet 12. Lock assembly 100 also includes a motor 140, a first switch 150, and a second switch 152 mounted to support plate 160. First switch 150 is configured for determining when first door 110 is in the closed position. Similarly, second switch 152 is configured for determining when second door 120 is in the closed position. When first and second switches 150 and 152 determine that first and second doors 110 and 120, respectively, are in the closed position, motor 140 may selectively actuate latch 130 to engage first door 110. Processing device is in communication with first switch 150, second switch 152, and motor 140, e.g., to receive signals from first and second switches 150 and 152 and operate motor 140.

Latch 130 extends between a first end portion 132 and a second end portion 134. First end portion 132 of latch 130 is rotatably mounted to support plate 160 and is positioned within cabinet 12 (FIG. 2). First end portion 132 of latch 130 is in mechanical communication with motor 140 such that motor 140 may selectively rotate latch 130 as described in greater detail below. Second end portion 134 of latch 130 defines a hook 136. Hook 136 selectively engages first door 110 in order to secure first door 110 in the closed position.

It should be understood that latch 130 is provided by way of example only. Other suitable latches and configurations may be used as well. For example, rather than defining hook 137, latch 130 may actuate a pin or secondary latch that engages first door 110 in order to secure doors 16 in the closed position.

First and second doors 110 and 120 define a gap 102 therebetween, e.g., when first and second doors 110 and 120 are in the closed position shown in FIG. 5. In particular, gap 102 is defined between sidewall 118 of first door 110 and sidewall 126 of second door 120, e.g., along the lateral direction L. A pair of seals 170 is positioned at gap 102 when first and second doors 110 and 120 are in the closed position. Pair of seals 170 can assist with sealing chamber 14 (FIG. 1) of cabinet 12. For example, pair of seals 170 can hinder a flow of heated air out of chamber 14 and/or a flow of cooler air into chamber 14 when doors 16 are in the closed position.

Each seal of pair of seals 170 is mounted to a respective door of doors 16 and extends into gap 102, e.g., along the lateral direction L, when doors 16 are in the closed position. In particular, pair of seals 170 includes a first seal 172 and a second seal 176. First seal 172 is mounted to first door 110, e.g., to interior wall 116 or sidewall 118 of first door 110. Conversely, second seal 176 is mounted to second door 120, e.g., to interior wall 124 or sidewall 128 of second door 120.

The seals of pair of seals 170 engage each other, e.g., in an overlapping manner, when doors 16 are in the closed position. In particular, the seals of pair of seals 170 engage each other when both first door 110 and second door 120 are in the closed position. As an example, when first and second doors 110 and 120 are in the closed position, second seal 176 engages or is in contact with first seal 172 such that first seal 172 overlaps second seal 176. When first and second seals 172 and 176 engage and overlap each other, first and second seals 172 and 176 can assist within containing cooking fumes and heat within chamber 14 of cabinet 12. To assist with such sealing, first and second seals 172 and 176 extend longitudinally along the vertical direction V as may be seen in FIG. 1.

In the exemplary embodiment shown in FIG. 3, first seal 172 has a linear cross-section or profile in a plane that is perpendicular to the vertical direction V (FIG. 1). Conversely, second seal 172 has a curved cross-section or profile in a plane that is perpendicular to the vertical direction V. However, in alternative exemplary embodiments, first and second seals 172 and 176 may have any suitable cross-section or profile in a plane that is perpendicular to the vertical direction V. For example, first and second seals 172 and 176 may both have a linear or curved cross-section or any suitable combination of linear and curved cross-section components or sections. Thus, the shape of first and second seals 172 and 176 shown in FIG. 3 is not intended to limit the present subject matter in any aspect.

FIGS. 5-6 provide partial, section views of oven appliance 10 and illustrate lock assembly 100 selectively securing first door 110 in the closed position. Portions of first door 110 have been removed to illustrate details of lock assembly 100 and the interaction between lock assembly 100 and first door 110.

As may be seen in FIG. 5, interior wall 116 of first door 110 defines an opening 112. When first door 110 is in the closed position, latch 130 extends through opening 112 and into first door 110. From the position shown in FIG. 5, motor 140 can rotate latch 130 to the position shown in FIG. 6. In FIG. 6, hook 136 of latch 130 engages first door 110 and secures first door 110 in the closed position. Conversely, from the position shown in FIG. 6, motor 140 can rotate latch 130 back to the position shown in FIG. 5, e.g., in order to permit first door 110 to rotate to the open position.

As discussed above, latch 130 secures first door 110 in the closed position in FIG. 6. Thus, latch 130 hinders first door 110 from rotating away from the closed position towards the open position. With first door 110 secured in the closed position, oven appliance 10 includes features for securing second door 120 in the closed position as well. In particular, when latch 130 of lock assembly 100 engages first door 110 and secures first door 110 in the closed position, first seal 172 engages and overlaps second seal 176 and hinders second door 120 from rotating towards the open position. Thus, the interaction between first seal 172 and second seal 176 secures second door 120 in the closed position, e.g., despite latch 130 not engaging second door 120.

As an example, from the open position shown in FIG. 3, a user may push on handles 18 to rotate doors 16 towards the closed position shown in FIG. 5. As doors 16 rotate, first and second seals 172 and 176 overlap and engage each other as shown in FIG. 4. With first and second doors 110 and 120 in the closed position shown in FIG. 5, the user can activate a cleaning cycle of oven appliance 10 in which chamber 14 reaches a relatively high temperature, e.g., between about eight hundred and one thousand degrees Fahrenheit. Regulations and/or standards can require doors 16 to be secured in the closed position during the cleaning cycle in order to hinder access to chamber 14.

To secure doors 16 in the closed position, lock mechanism 100 can be used. With first and second doors 110 and 120 in closed position, first switch 150 and second switch 152 are actuated by first and second doors 110 and 120, respectively. Thus, first and second switches 150 and 152 can be used to confirm the first and second doors 110 and 120 are in the closed position. Motor 140 can then be activated to rotate latch 130 from the position shown in FIG. 5 to the position shown in FIG. 6 such that hook 136 of latch 130 engages first door 110 and secures first door 110 in the closed position.

With first door 110 secured in the closed position by lock assembly 100, pair of seals 170 cooperate to maintain second door 120 in the closed position. In particular, first seal 172 overlaps and engages second seal 176. Because first seal 172 is held stationary by lock mechanism 100 and first seal 172 overlaps and engages second seal 176, second seal 176 restrains second door 120 and hinders second door 120 from rotating towards the open position. Thus, second door 120 can be secured in the closed position with pair of seals 170 and without latch 130 directly engaging second door 120.

After the cleaning cycle is complete, motor 137 may be activated to shift or urge hook 137 such that hook 137 does not engage or contact first door 110 in order to permit first door 110 to be opened. The user may then pull on handles 18 in order to shift doors 16 to the open position such that latch 130 is removed from first door 130 through opening 112. When doors 16 are in the open position, first and second switches 150 and 152 are de-actuated, e.g., such that motor 140 is prevented from shifting latch 130 and the cleaning cycle of oven appliance 10 cannot be initiated. Thus, latch 130 will not shift and impede doors 16 from being closed by the user, and oven appliance 10 will not initiate a cleaning cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining a chamber for the receipt of food items for cooking;

a heating element for heating the chamber of said cabinet;

a first door and a second door rotatably mounted to said cabinet, said first and second doors each having an exterior wall spaced apart from an interior wall with a sidewall extending between the exterior and interior walls, the sidewalls of said first and second doors defining a gap therebetween when said first and second doors are in a closed position;

a latch mounted to said cabinet and configured for selectively securing said first door in the closed position;

a first seal mounted to said first door at the gap between said first and second doors; and a second seal mounted to said second door at the gap between said first and second doors, said first and second seals being in overlapping contact with each other when said first and second doors are in the closed position such that said second door is secured in the closed position when said latch secures said first door in the closed position.

2. The oven appliance of claim 1, wherein the interior wall of said first door defines an opening, said latch received within said first door through the opening of the interior wall when said first door is in the closed position.

3. The oven appliance of claim 2, wherein said latch extends longitudinally between a first end portion and a second end portion, the first end portion of said latch rotatably mounted to said cabinet, the second end portion of said latch defining a hook, the hook of said latch received within said first door through the opening of the interior wall and engaging the interior wall of said first door in order to secure said first door in the closed position.

4. The oven appliance of claim 1, further comprising a motor in mechanical communication with said latch such that said motor selectively rotates said latch in order to secure said first door in the closed position.

5. The oven appliance of claim 1, further comprising a first switch configured for detecting when said first door is in the closed position.

6. The oven appliance of claim 5, further comprising a second switch configured for detecting when said second door is in the closed position.

7. The oven appliance of claim 1, wherein said first seal is mounted to the interior wall or the sidewall of said first door.

8. The oven appliance of claim 7, wherein said second seal is mounted to the interior wall or the sidewall of said second door.

9. The oven appliance of claim 1, wherein said cabinet defines a vertical direction, at least one of said first seal and said second seal having a curved cross-section in a plane that is perpendicular to the vertical direction.

10. The oven appliance of claim 1, wherein said first and second seals engage each other when said first and second doors are in the closed position in order to assist with sealing the chamber of said cabinet.

11. An oven appliance, comprising:

a cabinet defining a chamber for the receipt of food items for cooking, the cabinet defining a lateral direction and a vertical direction;

a heating element for heating the chamber of said cabinet;

a pair of doors rotatably mounted to said cabinet, said pair of doors defining a gap therebetween when said pair of doors is in a closed position;

a latch mounted to said cabinet and configured for selectively securing one of said pair of doors in the closed position; and a pair of seals positioned at the gap between said pair of doors for assisting with sealing the chamber of said cabinet when said pair of doors is in the closed position, each seal extending longitudinally along the vertical direction, each seal of said pair of seals mounted to a respective door of said pair of doors and extending into along the lateral direction into the gap, the seals of said pair of seals engaging and overlapping each other when said pair of doors is in the closed position such that both doors of said pair of doors are secured in the closed position when said latch secures the one of said pair of doors in the closed position.

12. The oven appliance of claim 11, wherein one of said pair of doors defines an opening, said latch received within the one of said pair of doors through the opening when the one of said pair of doors in the closed position.

13. The oven appliance of claim 12, wherein said latch extends longitudinally between a first end portion and a second end portion, the first end portion of said latch rotatably mounted to said cabinet, the second end portion of said latch defining a hook, the hook of said latch received within the one of said pair of doors through the opening and engaging the one of said pair of doors in order to secure the one of said pair of doors in the closed position.

14. The oven appliance of claim 11, further comprising a motor in mechanical communication with said latch such that said motor selectively rotates said latch in order to secure the one of said pair of doors in the closed position.

15. The oven appliance of claim 11, further comprising a first switch configured for detecting when the one of said pair of doors is in the closed position.

16. The oven appliance of claim 15, further comprising a second switch configured for detecting when the other of said pair of doors is in the closed position.

17. The oven appliance of claim 11, wherein said cabinet defines a vertical direction, at least one of said pair of seals having a curved cross-section in a plane that is perpendicular to the vertical direction.

18. An oven appliance comprising:

a cabinet defining a chamber for the receipt of food for cooking, the chamber accessible through an opening defined by said cabinet;

a heating element for providing heat to the food for cooking in the chamber;

a first door and a second door mounted proximate to the opening, said first and second doors configured for permitting selective access to the chamber of said cabinet;

means for selectively securing said first door in a closed position; and means for securing said second door in the closed position when said first door is secured in the closed position.

* * * * *